United States Patent [19]

Dimmock

[11] Patent Number: 4,805,796

[45] Date of Patent: Feb. 21, 1989

[54] DUAL GAS PRESSURE VESSEL

[75] Inventor: Ivan H. Dimmock, Weston-super-Mare, England

[73] Assignee: BAJ Limited, England

[21] Appl. No.: 116,458

[22] Filed: Nov. 3, 1987

[30] Foreign Application Priority Data

Nov. 6, 1986 [GB] United Kingdom ..... 8626535

[51] Int. Cl.[4] ..... F17B 1/14

[52] U.S. Cl. ..... 220/89 A

[58] Field of Search ..... 220/89 A

[56] References Cited

U.S. PATENT DOCUMENTS

| | | | |
|---|---|---|---|
| 3,815,779 | 6/1974 | Ludwig et al. | 220/89 A |
| 3,901,259 | 8/1975 | Banbury | 220/89 A |
| 4,207,913 | 6/1980 | Fike, Jr. | 220/89 A |
| 4,655,070 | 4/1987 | Clift | 220/89 A |
| 4,669,626 | 6/1987 | Mozley | 220/89 A |

*Primary Examiner*—Joseph Man-Fu Moy

*Attorney, Agent, or Firm*—Wallenstein Wagner Hattis & Strampel, Ltd.

[57] ABSTRACT

A dual gas pressure vessel assembly comprising a pressure vessel shell, a piston dividing the interior of the shell into a first chamber and a second chamber, an exhaust passage leading from a portion of said first chamber spaced from the piston, a stop limiting movement of the piston towards the exhaust passage, and a burster disc in the piston. The piston carries frangible coupling means rigidly coupling the piston to the shell. In use the two chambers are respectively filled with the two gases required. When the exhaust passage is opened the first gas will be discharged from the first chamber, the piston will move against the stop and, when substantially all the first gas has been discharged, the burster disc will fracture, connecting the second chamber to the exhaust passage.

8 Claims, 1 Drawing Sheet

DUAL GAS PRESSURE VESSEL

FIELD OF THE INVENTION

The present invention relates to dual gas pressure vessels, and particularly to a vessel arranged to supply a controlled amount of a first gas followed by a controlled amount of a second gas.

BACKGROUND OF THE INVENTION

In the operation of Joule-Thompson minicoolers it has been found desirable to use two different gases in sequence, the first gas being used to enable a low temperature to be obtained quickly, and the second gas being used to maintain that temperature during the operating period. One way of providing two gases in sequence is to use a separate gas bottle for each, in combination with a suitably controlled system of valves. However, this is expensive and complicated, and the resulting system also tends to be heavy—something which is very undesirable in many situations.

It is an aim of the present invention at least to alleviate these problems. It is a further aim of the present invention to provide a light-weight, relatively simple pressure vessel which will automatically discharge a controlled amount of a first gas followed by a controlled amount of a second gas.

SUMMARY OF THE INVENTION

The present invention meets these aims by providing a dual gas pressure vessel which comprises a first chamber having an exhaust therein, and a second chamber separated from the first by dividing means; and connecting means arranged to operate to connect the exhaust to the second chamber when the pressure differential between the two chambers exceeds a predetermined level. Preferably, the connecting means comprises a burster disc.

Thus, in use, a first gas is filled into the first chamber and a second gas into the second chamber. When the exhaust from the first chamber is opened, the pressure in the first chamber will fall and when it has fallen to a level such that the pressure difference between the two chambers exceeds the said predetermined level, the connecting means will operate to connect the second chamber to the exhaust.

For some applications, and particularly for the Joule-Thompson minicooler referred to above, it may be desirable for the first chamber to be completely or substantially completely emptied of the first gas before the connecting means operates. Preferably, therefore, there is a movable wall dividing the first chamber from the second chamber. The movable wall may be a bellows or diaphragm but is preferably a movable piston. The piston may have a fixed portion which is sealed to the wall of the pressure vessel and a movable portion which is connected to the fixed portion by a frangible gas-tight joining zone such as a weakened region or score line. With this arrangement, a seal between the two chambers can be provided which is substantially gas tight and will remain so over long periods of time, something which is difficult to achieve if the seal is carried by the moving piston itself.

Preferably the connecting means, e.g. a burster disc, is carried by the movable wall.

BRIEF DESCRIPTION OF THE SEVERAL VIEWS OF DRAWINGS

The invention may be carried into practice in various ways but one pressure vessel embodying the invention will now be described by way of example with reference to the accompanying drawings, in which:

FIG. 1 is a longitudinal section through the vessel of the present invention; and FIG. 2 is a fragmentary view of a pressure vessel similar to that shown in FIG. 1 but with an alternative construction of frangible piston.

DETAILED DESCRIPTION

Figure 1:
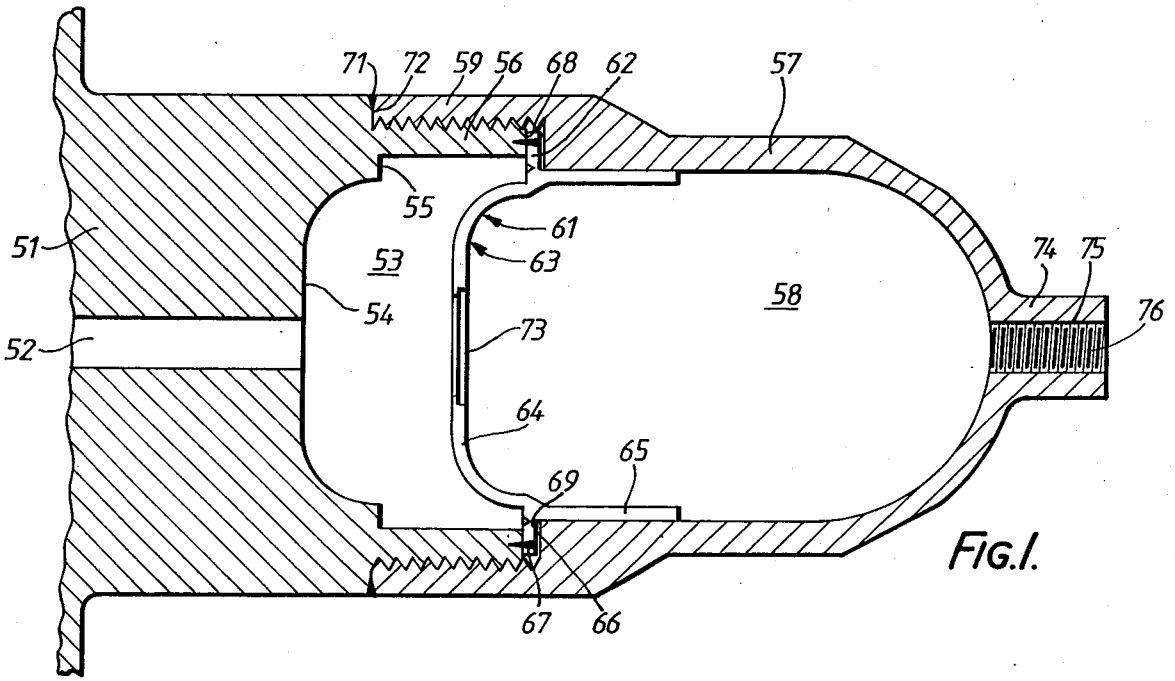

The dual gas pressure vessel shown in FIG. 1 is a body of revolution and comprises a body portion 51 formed with an exhaust passage 52 and an open-ended first pressure chamber 53 from which the exhaust passage 52 leaves and which is bounded by a dish-shaped end wall 54 extending to a step or shoulder 55 and by a cylindrical flange 56. The pressure vessel also comprises a dome-shaped cover portion 57 which bounds a second pressure chamber 58 and which is formed with a cylindrical flange 59 formed with a female screw-thread to cooperate with a male screw-thread on the flange 56 on the body portion 51.

The first chamber 53 and second chamber 58 are separated by a rigid piston member 61 which comprises a fixing and sealing radial flange 62 and a moving portion 63 consisting of a dish-shaped portion or piston crown 64 and a cylindrical skirt 65 which is a sliding fit within the cover portion 57. At the transition between the crown 64 and the skirt 65 there is a circumferential separation line 66 in the form of a score providing a line of weakness. The flange 62 is electron beam stake-welded at 67 to the outer end 68 of the flange 56 on the body portion 51 and is trapped between this end 68 and a shoulder 69 on the cover 57. The two pressure chambers 53 and 58 are sealed from one another by the stake weld 67 and possibly also by sealing rings compressed between the flange 62 on the piston member and, on one side, the outer end 68 of the flange 56 and, on the other side, the shoulder 69 on the cover 57. A seal to the outside is provided by a circumferential electron beam weld 71 which joins the end of the flange 59 on the cover to a shoulder 72 on the body portion 51.

The crown 64 of the piston member 61 carries centrally a burster disc 73. The cover 57 has a central boss 74 formed with an axial filling aperture 75 which can be closed by a plug 76.

The device is charged by passing a first gas (due to be released first) through the exhaust passage 52 into the first chamber 53 and, at the same time, passing a second gas through the aperture 75 into the second chamber 58. The nature of the two gases will naturally vary according to their ultimate desired use, but where it is intended to use the dual gas pressure vessel to provide cooling of a Joule-Thompson minicooler the first gas may conveniently be Freon 14 or methane, and the second gas argon or nitrogen. The charging pressure, in this example, is of the order of 6000 psi (41,380 kPa).

The operation of the device will now be described. When the exhaust 52 is vented, the first gas passes out from the first chamber 53 reducing the pressure in the first chamber. After the pressure in the first chamber 53 has fallen to a predetermined level, the difference in pressures between the chambers 58 and 53 will be such that the piston member 61 ruptures at the score line 66 and the movable portion 63 will move towards the exhaust passage 52. The shapes of the end wall 54 of the chamber 53 and the piston crown 64 are complementary so that substantially all the first gas is expelled from the chamber 53 when the piston comes to rest against the end wall 54. The pressure differential across the piston crown 64 will then rise to a level at which the burster disc 73 ruptures thus allowing the second gas to escape from the second chamber 58 through the exhaust passage 52.

In a typical example, the first gas is expelled in about half a second, and is used to quickly provide low temperature in a Joule-Thompson minicooler; the second gas is expelled over a period of about 20 to 30 seconds, and is used to maintain the low temperature of the minicooler during its operating period.

Figure 2:
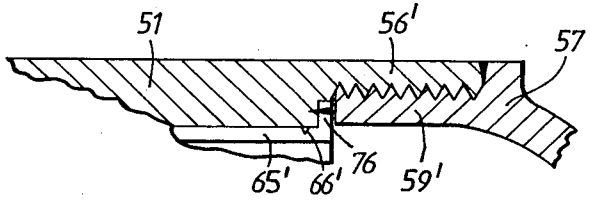

A modification of the device is shown in FIG. 2 in which like parts will be designated with like numerals. This embodiment differs from the embodiment of FIG. 1 in that a separation line or line of weakness 66' is formed in the piston skirt 65' and the piston is anchored by a flange 76 at the distal end of the piston skirt. In this embodiment, the cover 57 has a cylindrical flange 59' which screws within the cylindrical flange 56' on the body portion and the skirt 65' slides in the body portion 51 rather than in the cover 57.

I claim:

1. In a dual gas pressure vessel for sequentially dispensing two different gases comprising a housing defining a cavity having dividing means defining first and second chambers with exhaust means leading from said first chamber which has a first pressurized gas therein so that said first pressurized gas is dispensed upon opening of said exhaust means, said dividing means having burster means and said second chamber having a second pressurized gas, said burster means placing said second chamber in communication with said exhaust when the pressure differential between said chamber exceeds a predetermined level.

2. A dual gas pressure vessel according to claim 1 wherein said dividing means is a movable wall.

3. A dual gas pressure vessel according to claim 2 wherein said movable wall is a movable piston.

4. A dual gas pressure vessel according to claim 3 wherein said piston has a fixed portion which is sealed to the housing and a movable portion which is connected to said fixed portion by a frangible gas-tight joining zone.

5. A dual gas pressure vessel according to claim 4 wherein said burster means is carried by said movable wall.

6. A dual gas pressure vessel according to claim 5 wherein said burster means is a burster disc.

7. In a dual gas pressure vessel assembly for sequentially dispensing two different pressurized fluids comprising a pressure vessel shell having an interior, a piston dividing said interior into a first chamber and a second chamber respectively adapted for having first and second pressurized fluids therein, an exhaust passage leading from a portion of said first chamber spaced from said piston for exhausting said first pressurized fluid, a stop limiting movement of said piston towards said exhaust passage, and burster means in said piston placing said second chamber in communication with said exhaust passage after said first fluid has been dispensed.

8. A dual gas pressure vessel according to claim 7 wherein said piston carries frangible coupling means rigidly coupling said piston to said shell.

* * * * *